US006419001B2

(12) United States Patent
Labbé

(10) Patent No.: US 6,419,001 B2
(45) Date of Patent: Jul. 16, 2002

(54) VENETIAN BLIND HAVING SEGMENTED TILT ADJUSTMENT

(76) Inventor: Roger Labbé, 4768, Laval street, Lac Mégantic, Québec (CA), G6B 1C7

( * ) Notice: Subject to any disclaimer, the term of this patent is extended or adjusted under 35 U.S.C. 154(b) by 0 days.

(21) Appl. No.: 09/878,255

(22) Filed: Jun. 12, 2001

(30) Foreign Application Priority Data

Jun. 13, 2000 (GB) ..... 0014253

(51) Int. Cl.[7] ..... E06B 9/30

(52) U.S. Cl. ..... 160/115; 160/168.1 R

(58) Field of Search ..... 160/168.1 R, 173 R, 160/178.2 R, 177 R, 178.3 R, 115, 176.1 R, 178.1 R

(56) References Cited

U.S. PATENT DOCUMENTS 2,459,517 A * 1/1949 Gearhart
6,015,001 A * 1/2000 Tronsgard et al.
6,318,439 B1 * 11/2001 Matsubara

* cited by examiner

*Primary Examiner*—Blair M. Johnson

(57) ABSTRACT

A window blind including a shade suspended from a generally elongated head bar, the window blind including a set of first slats. Each of the first slats having a first slat aperture extending therethrough. A first tilt string defining a pair of first tilt string segments is suspended from the head bar. A set of first supporting strings extends between the first tilt string segments, each of the first supporting strings supporting a corresponding first slat. A first tilt mechanism is attached to the head bar and mechanically coupled to the first tilt string segments for selectively allowing relative vertical movement of the first tilt string segments in opposite direction relative to each other so as to pivot the first slats between open and closed configurations. A second individually tiltable shade section includes a set of second slats positioned in an underlying relationship relative to the first slats. A second tilt string defines a pair of second tilt string segments suspended from the head bar. The second tilt string segments extend vertically from the head bar through the vertically aligned first slat apertures. A set of second supporting strings extends between the second tilt string segments, each of the second supporting string supporting a corresponding second slat. A second tilt mechanism is attached to the head bar and mechanically coupled to the second tilt string segments for selectively allowing relative vertical movement of the second tilt string segments in opposite direction relative to each other so as to pivot the second slats between open and closed configurations. A biasing loop is provided for biasing the second tilt string segments towards a predetermined second segment spaced relationship relative to each other in a biasing region located between a lowermost first slat and an uppermost second slat. The biasing loop ensures that the second tilt string segments slide freely within the vertically aligned first slat apertures.

16 Claims, 3 Drawing Sheets

VENETIAN BLIND HAVING SEGMENTED TILT ADJUSTMENT

FIELD OF THE INVENTION

The present invention relates to the general field of venetian type blinds and is particularly concerned with a venetian blind having segmented tilt adjustment features.

BACKGROUND OF THE INVENTION

Venetian type blinds are used extensively in numerous settings for dressing various types of windows. They include sets of leaves or slats that can be pivoted between an opened configuration wherein they let in air and light and a closed configuration wherein their peripheral edges override each other to give the desired privacy.

Conventional venetian blinds are controlled by two ropes and four strings.

The ropes are used to lift the whole venetian blind up while the strings control the inclination angle of the slats. The inclination angle of the slats, in turn, allow adjustment of the entry of light.

The two strings are tied to a string attachment which is fixed to a rotary beam in a string hanger protectively enclosed within the top bar.

When an intended user rotates an adjusting rod or wand, the torque is transmitted through a gear box to the rotary beam so that the latter will be rotated about its longitudinal axis.

The rotation of rotary beam, in turn, causes one of the strings to rise and the other one to descend thus modifying the angle of the slats.

In the conventional venetian blind, all the slats are adjusted as an entity. In other words, all the slats are adjusted simultaneously to the same inclination. If one section of the blind is opened, all slats are in the opened position and if one section is closed they are all closed.

In numerous situations, it is desirable to divide the slats into groups whereby each of the groups can be tilted independently of each other and wherein all of the slats can still be raised by manipulation of a rope.

For example, it may be preferred that the slats of the upper half of the venetian blind be kept horizontal to allow light to enter while the slats of the its lower half are adjusted to a steep inclination to intercept light.

This type of blind is especially suitable for use in hospitals, schools, commercial and residential buildings where top lights are desired but wherein it is desired to cut out the view into the room or, for example, in situations it is desirable to intercept incoming sunlight so that articles in the room which are vulnerable to radiation may not be exposed to it.

This problem has been recognized in the past and, hence, there has been numerous suggestions on how to modify the conventional venetian blind so that one section of the blind can be opened while the other is closed.

For example, U.S. Pat. No. 4,621,672 naming Pei-Shun Hsu as inventor issued Nov. 11, 1986 discloses a window blind which includes a regulating mechanism that can set the slats at different inclinations so that when upper slats are opened, lower slats can be closed and vice versa. The regulating mechanism includes a first and a second roller both mounted for rotation about two parallel horizontal axes in the support. A component is provided for driving the first and second rollers separately.

A first regulating string is attached to the first roller and extends downward on the front and rear sides of the shade. The first string has crossed pieces attached thereto at regular intervals for regulating some of the slats.

A second regulating string is attached to the second roller and extends downward on the front and rear sides of the shade.

A second regulating string has second cross pieces attached thereto at regular intervals for regulating the remaining slats. The slats regulated by the first cross pieces are placed above the slats regulated by the second cross pieces.

Although providing independent tilting of two groups of slats, the proposed mechanism suffers from numerous drawbacks including the fact that the regulating strings are arranged in such a manner that they will frictionally abut against adjacent components. The frictional contact, in turn, creates undue stress in the strings which alters their functioning and may eventually lead to breakage thereof.

Numerous other control systems have been proposed but tend to be complicated and bulky, and consequently have failed to provide a satisfactory solution.

Furthermore, they typically require considerable modification to the existing mechanisms and apparently are not too practical inasmuch as none of these devices are commonly available on the market.

Accordingly, there exists a need for an improved venetian blind having segmented tilt adjustment features.

Advantages of the present invention include that the proposed structure allows for a predetermined grouping of slats which can be tilted independently of the remaining slats of the blind. The groups of slats may further be lifted as a whole without altering the tilt control mechanism.

Mainly, the proposed structure is specifically designed so that no tilt adjustment features will hang out of the blind when the groups of slats are lifted as a whole.

Also, the proposed structure is specifically designed so as to minimize friction between adjacent components and particularly to reduce friction between moving strings and adjacent components so as to reduce the risk of altering the functioning of the slat tilt mechanism and reducing the risk of undue wear.

Furthermore, the proposed structure is specifically designed so as to be retro-fittable to conventional venetian blind structures with reduced modifications needed thereto.

Also, the proposed structure is adapted to allow functional use of independent slat tilting without deterring to the overall esthetical aspect of the venetian blind.

Still further, the proposed structure is specifically designed so as to be manufacturable using conventional forms of manufacturing so as to provide a slat tilting mechanism which will be economically feasible, long lasting and relatively trouble-free in operation.

SUMMARY OF THE INVENTION

In accordance with an embodiment of the present invention, there is provided a window blind including a shade suspended from a generally elongated head bar, the window blind comprising: at least two generally elongated and horizontal first slats, the first slats being in a superposed relationship relative to each other, each of the first slats having a first slat aperture extending therethrough, the first slat apertures of superposed first slats being in a generally vertically aligned relationship relative to each other; a first tilt string defining a pair of first tilt string segments suspended from the head bar, the first tilt sting segments being in a generally parallel and spaced relationship relative to one another; a set of first supporting strings extending between the first tilt string segments, each of the first supporting strings supporting a corresponding first slat; a first tilt mechanism attached to the head bar and mechanically coupled to the first tilt string segments for selectively allowing relative vertical movement of the first tilt string segments in opposite direction relative to each other so as to pivot the first slats between open and closed configurations; at least two generally elongated and horizontal second slats, the second slats being positioned in an underlying relationship relative to the first slats and in a superposed relationship with each other; a second tilt string defining a pair of second tilt string segments suspended from the head bar, the second tilt string segments being in a generally parallel and spaced relationship relative to one another, the second tilt string segments extending vertically from the head bar through the vertically aligned first slat apertures; a set of second supporting strings extending between the second tilt string segments, each of the second supporting string supporting a corresponding second slat; a second tilt mechanism attached to the head bar and mechanically coupled to the second tilt string segments for selectively allowing relative vertical movement of the second tilt string segments in opposite direction relative to each other so as to pivot the second slats between open and closed configurations; a biasing means for biasing the second tilt string segments towards a predetermined second segment spaced relationship relative to each other in a biasing region located between a lowermost first slat and an uppermost second slat, the biasing means ensuring that the second tilt string segments slide freely within the vertically aligned first slat apertures.

Preferably, each of the first slat aperture defines a corresponding first aperture peripheral edge and wherein the biasing means ensures that the second tilt string segments slide freely within the vertically aligned first slat apertures without contacting the first aperture peripheral edges.

Conveniently, the biasing means includes a retaining clip, the retaining clip defining an inner guiding surface, one of the second tilt string segments being attached to the retaining clip so as to move vertically solidarly therewith while the other second tilt string segments slides freely against the inner guiding surface.

Preferably, the retaining clip has the general configuration of a loop, one of the second tilt string segments being attached to the loop while the other second tilt string segments slides freely against the inner guiding surface defined by the loop.

Conveniently, the loop has a generally oval configuration. Preferably, one of the second tilt string segments is attached to the loop by having an attachment segment of the loop extend therethrough.

Conveniently, one of the second tilt string segments is attached to the loop by having an attachment segment of the loop extend therethrough, the attachment segment of the loop being positioned adjacent a first longitudinal end of the loop; the other second tilt string segments sliding freely against the inner guiding surface defined by a guiding segment of the loop positioned adjacent a second longitudinal end of the loop, the second longitudinal end of the loop being positioned longitudinally opposite the first longitudinal end of the loop.

Preferably, the window blind further comprises a base bar attached to the shade underneath the lowermost second slat; a drawstring defining at least one drawstring segment, the at least one drawstring segment extending from the head bar and being attached to the base bar, the at least one drawstring segment extending through the first slat apertures and through the loops formed by the clips; a drawstring pulling means for allowing the pulling of the drawstring so as to allow the base bar and the first and second slats to be lifted towards the head bar in a shade retracted configuration.

Preferably, the retaining clip is configured, sized and positioned so that when the shade is in the shade retracted configuration, the section of the second tilt string segment extending through the first slat apertures is folded between the first slats without protruding from a peripheral edge of the first slats.

In accordance the present invention, there is also provided in a window blind including a shade suspended from a generally elongated head bar, the shade including a first shade section, the first shade section including at least two generally elongated and horizontal first slats, the first slats being in a superposed relationship relative to each other, each of the first slats having a first slat aperture extending therethrough, the first slat apertures of superposed first slats being in a generally vertically aligned relationship relative to each other; a first tilt string defining a pair of first tilt string segments suspended from the head bar, the first tilt sting segments being in a generally parallel and spaced relationship relative to one another; a set of first supporting strings extending between the first tilt string segments, each of the first supporting strings supporting a corresponding first slat; a first tilt mechanism attached to the head bar and mechanically coupled to the first tilt string segments for selectively allowing relative vertical movement of the first tilt string segments in opposite direction relative to each other so as to pivot the first slats between open and closed configurations; a second individually tiltable shade section comprising: at least two generally elongated and horizontal second slats, the second slats being positioned in an underlying relationship relative to the first slats and in a superposed relationship with each other; a second tilt string defining a pair of second tilt string segments suspended from the head bar, the second tilt string segments being in a generally parallel and spaced relationship relative to one another, the second tilt string segments extending vertically from the head bar through the vertically aligned first slat apertures; a set of second supporting strings extending between the second tilt string segments, each of the second supporting string supporting a corresponding second slat; a second tilt mechanism attached to the head bar and mechanically coupled to the second tilt string segments for selectively allowing relative vertical movement of the second tilt string segments in opposite direction relative to each other so as to pivot the second slats between open and closed configurations; a biasing means for biasing the second tilt string segments towards a predetermined second segment spaced relationship relative to each other in a biasing region located between a lowermost first slat and an uppermost second slat, the biasing means ensuring that the second tilt string segments slide freely within the vertically aligned first slat apertures.

BRIEF DESCRIPTION OF THE DRAWINGS

An embodiment of the present invention will now be disclosed, by way of example, in reference to the following drawings in which.

DETAILED DESCRIPTION

Figure 2:
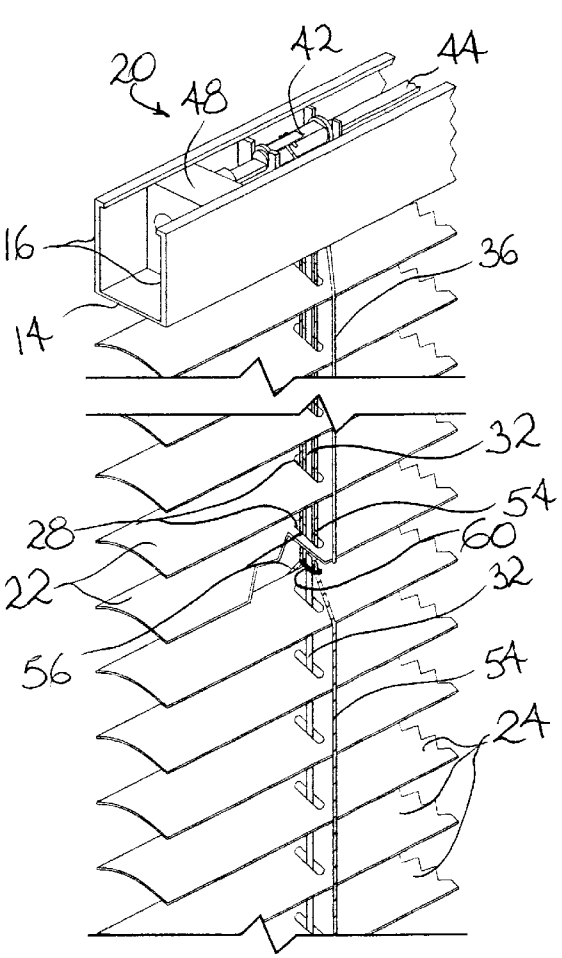
FIG. 2: in a partial perspective view with sections taken out, illustrates part of the venetian blind shown in FIG. 1.
Figure 1:
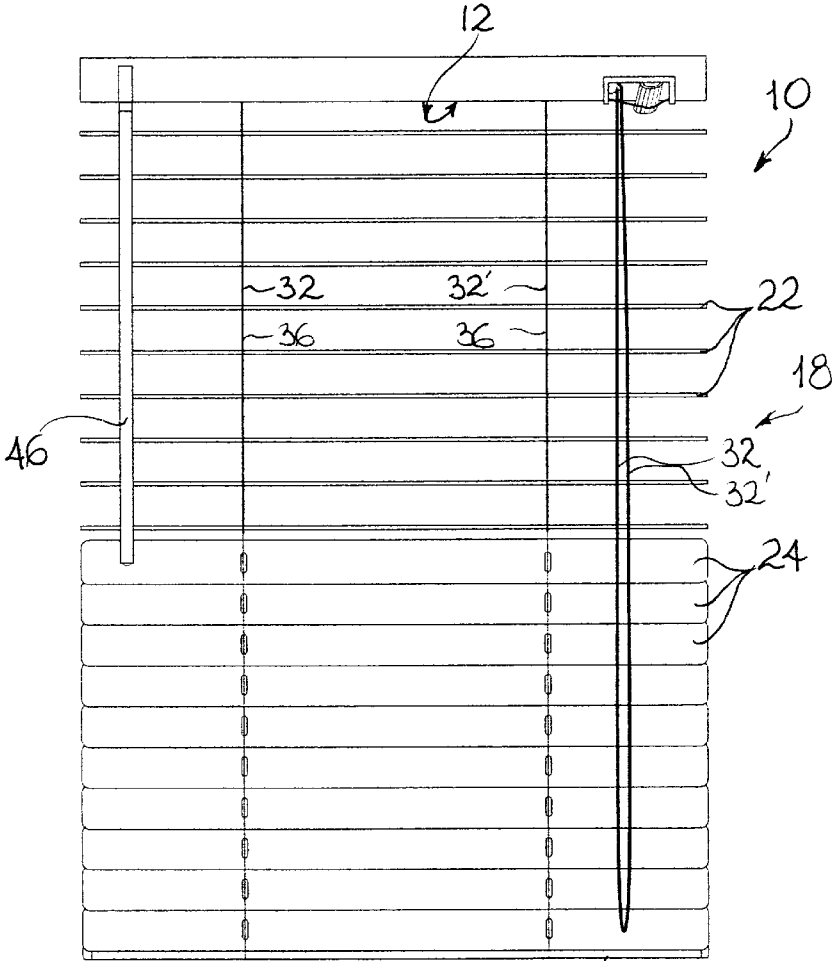
FIG. 1: in a front elevational view, illustrates a venetian blind having segmented tilt adjustment features in accordance with an embodiment of the present invention. The venetian blind being shown defining two distinct sections, an upper segment thereof being in an opened configuration while a bottom segment thereof is in a closed configuration.

Referring to FIG. 1, there is shown a venetian blind 10 having segmented tilt adjustment features in accordance with an embodiment of the present invention.

The venetian blind 10 is typically adapted to be mounted in a window structure (not shown), the particular type of which is immaterial to the invention.

However, it is particularly suitable for use where it is desired to position some of the slats in one position while other slats are in another position. This variation in the position of the groups of slats is found convenient for obtaining privacy, lighting and ventilation as mentioned above.

The venetian blind 10 includes a head bar 12 preferably having a generally "U"-shaped cross sectional configuration defining a head bar base wall 14 and a pair hear bar side walls 16 extending substantially perpendicularly and integrally from peripheral edges thereof.

The head bar 12 is adapted to be secured typically adjacent to the top of the window frame by means of suitable brackets or any other suitable means. The head bar 12 is adapted to act as support for the shade 18 part of the venetian blind 10. The head bar 12 also protectively at least partially encloses the slat tilt mechanism 20.

The slat tilt mechanism 20 is adapted to be used for selectively tilting predetermined groups of slats between opened and closed configurations.

In the embodiments shown in FIGS. 1 through 7, the two sets of slats are defined namely an upper set of slats 22 and lower set of slats 24.

It should be understood that the venetian blind 10 could define more than two sets of slats without departing from the scope of the present invention. As is well known in the art, each slat 22, 24 typically includes a generally elongated strip of substantially opaque material.

As shown more specifically in FIGS. 4 through 7, each slat 22, 24 preferably has a generally curved cross sectional configuration. A weighted base bar 26 is typically attached to shade 18 underneath the lower most slat 24 to help in holding the shade 18 in position.

Each slat 22 is provided with at least one and preferably two slat apertures 28 extending therethrough. The slat apertures 28 are preferably positioned adjacent corresponding longitudinal ends of each slat 22 in a symmetrical relationship relative to each other.

Each slat aperture 28 is configured and sized for allowing through passage of slat biasing components which will be hereinafter disclosed. Typically, although by no means exclusively, the slat apertures 28 have a generally oval configuration. The slat apertures 28 could take the form of conventional slat apertures or customized slat apertures 28 as needed.

Figure 4:
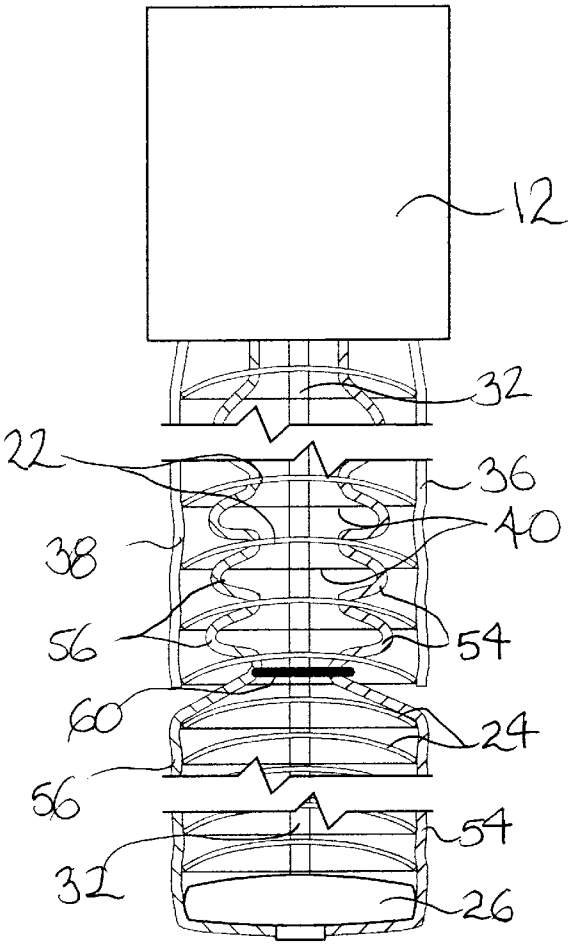
FIG. 4: in a partial longitudinal view with sections taken out, illustrates the venetian blind shown in FIGS. 1 through 3 in a retracted configuration.

A drawstring unit 30 is provided for allowing bottom bar 26 to be lifted towards the head bar 12 in a retracted configuration shown in FIG. 4. As is well known in the art, the drawstring unit 30 includes a pair of drawstring segments 32, 32' that form a close loop at one end, extend partially through the head rail 12 then divide into individual drawstring segments that are slidably inserted within corresponding slat apertures 28. The distal end of the drawstring segments 32, 32' are attached to the bottom bar 26.

A releasable locking mechanism 34 mounted within the head rail 12 is provided for locking the drawstring segments 32, 32' so as to allow for the releasable locking of the bottom bar 26 at various height levels.

The slat tilting mechanism 20 includes a first set of conventional slat tilting components including conventional first tilt string segments 36, 38 and a set of transversal first supporting strings 40 extending therebetween.

The slats 22 are abuttingly rested on the first supporting strings 40 and nested between the first tilt string segments 36, 38. The first tilt string segments 36, 38 form a continuous first string that is winded around a first tilting drum 42. The first tilting drum 42 is, in turn, mechanically coupled to a first rotary beam 44. A first tilt adjustment rod 46 is mechanically coupled to a gear box 48 which, in turn, is coupled so as to drive the rotary beam 44.

The intended user thus merely needs to rotate the first tilt adjustment rod 46 so that the torque transmitted through the gear box 48 rotates the first rotary beam 44 causing one of the first string segments 36, 38 to rise and the other one to descend and thus changing the inclination angle of the slats 22, as is well known in the art.

One of the main features of the present invention resides in the presence of a second set of tilt adjustment components including a second winding drum 50, mechanically coupled to a second rotary beam 52 driven by either the same gear box 48 or a second unit (not shown). A set of second tilt string segments 54, 56 and a set of transversal second supporting strings 58 is further provided.

The slats 24 are abuttingly rested on the second supporting strings 58 and nested between the second tilt string segments 54, 56. The second tilt string segments 54, 56 form a continuous second string that is winded around the second tilting drum 50. The second tilting drum 50 is, in turn, mechanically coupled to the second rotary beam 52. (A second tilt adjustment rod 46 is mechanically coupled to a gear box 48 which, in turn, is coupled so as to drive the rotary beam 44.)

A biasing component for biasing the second tilt string segments 54, 56 towards a predetermined spaced relationship relative to each other is further provided. The biasing component preferably takes the form of a generally oval shaped retaining clip 60 fixedly attached to one of the second tilt string segments 54, 56 and at least partially encircling the other one.

Figure 3:
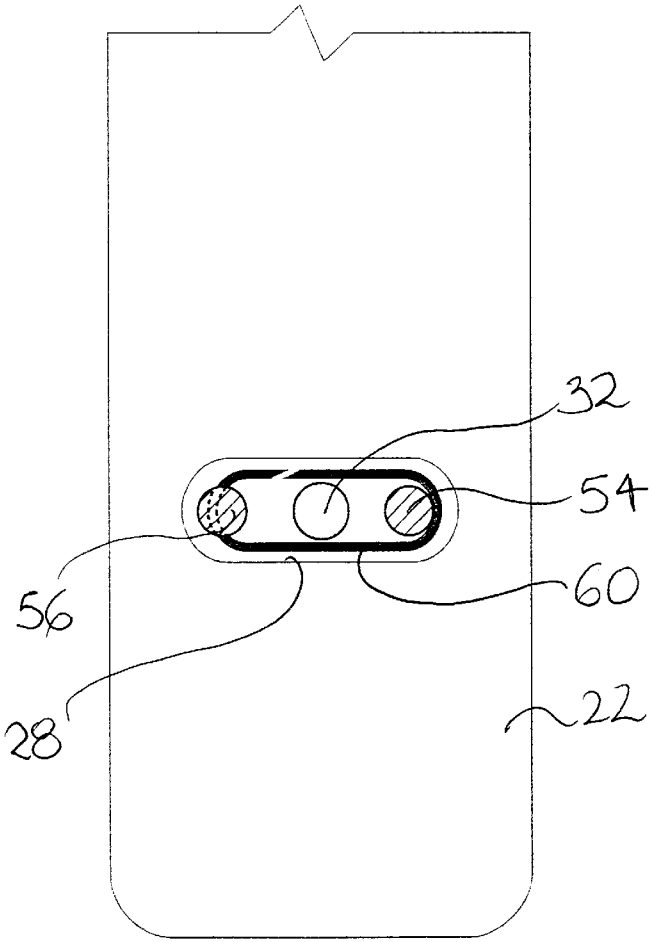
FIG. 3: in a partial transversal cross sectional view with sections taken out, illustrates part of the tilt control mechanism of the blind shown in FIGS. 1 and 2.

In the embodiment shown in FIG. 3, the biasing component 60 is fixedly attached to the string segment 56 while it partially encircles the string segment 54. It should be understood that the inverse configuration could be used without departing from the scope of the present invention.

The biasing component 60 is configured so as to allow the unattached string segment to slide freely relative thereto. The predetermined spacing between the second tilt string segments 54, 56 provided by the biasing component 60 is customized depending on the size of the slats 22, 24 so as to allow proper tilt movement of the slats 24 while preventing undue friction between the set of second tilt string segments 54, 56 and the set of first slats 22 and associated string segments 36 through 40.

Figure 6:
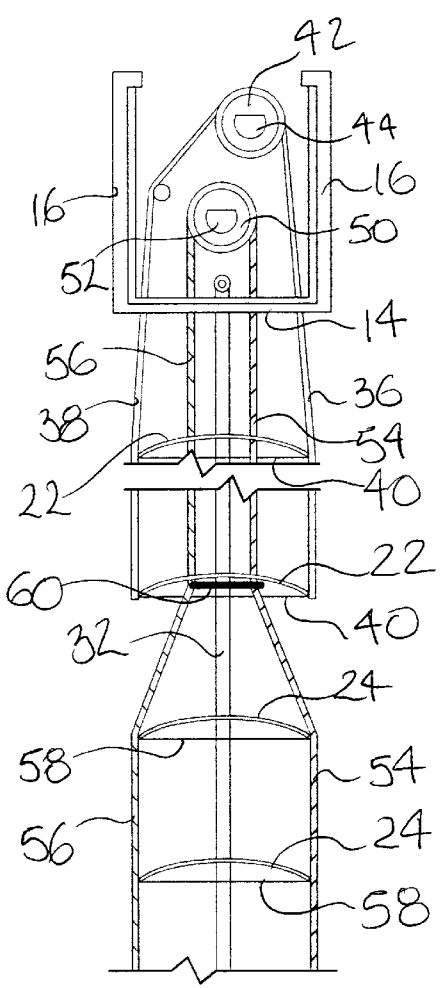
FIG. 6: in a partial longitudinal view with sections taken out, illustrates the venetian blind shown in FIGS. 1 through 4 with its slats in an opened configuration.

Typically, the set of second string segments 54, 56 form an angle generally designated by the reference character "A" in FIG. 6 when the first and second set of slats 22, 24 are in their opened configuration. The angle A prevents undue friction between adjacent components.

The biasing components 60 are preferably positioned between the uppermost slat 24 and the lowermost of slat 22. The slat apertures 28 are thus configured and sized so as to allow through passage of the set of second string segments 54, 56. The shade 18 can thus be easily folded to its retracted configuration shown in FIG. 4 when needed.

Figure 7:
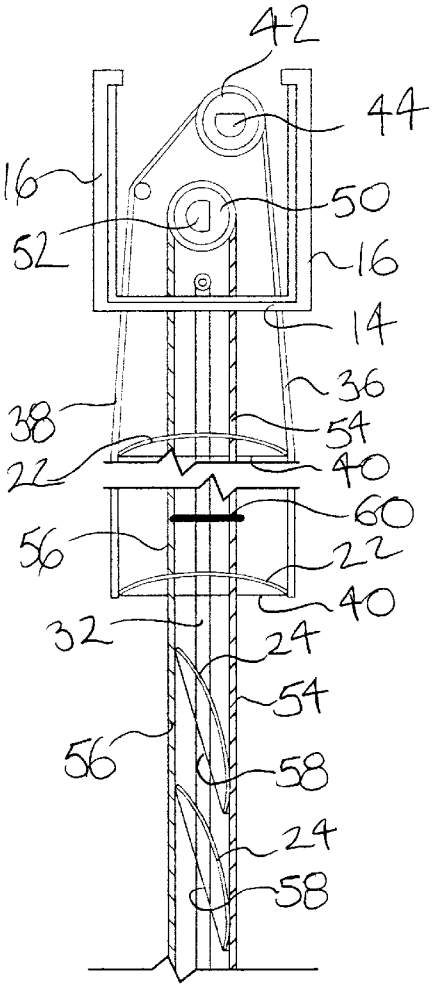
FIG. 7: in a partial longitudinal view with sections taken out, illustrates the venetian blind shown in FIGS. 1 through 4 with its slats partially in a reverse closed configuration.
Figure 5:
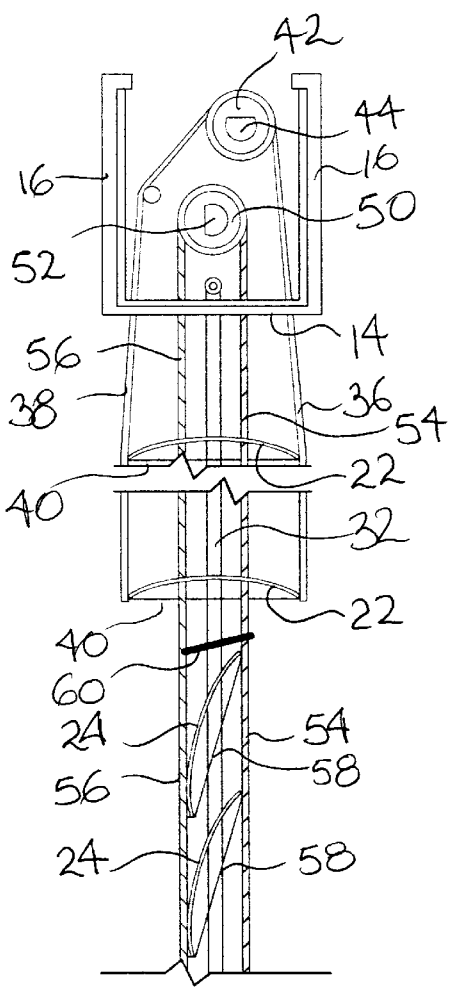
FIG. 5: in a partial longitudinal view with sections taken out, illustrates the venetian blind shown in FIGS. 1 through 4 with its slats in a partially opened configuration.

In use, as shown in FIGS. 5 through 7, the biasing components 60 allows bending of the second set of strings 54, 56 on the second winding drum 52 with consequent relative sliding movement therebetween. This relative sliding movement, in turn, allows the slat 24 to be tilted between opened and closed configuration without altering the conventional functioning of the first set of slats 22.

The embodiments of the invention in which an exclusive privilege or property is claimed are defined as follows:

1. A window blind including a shade suspended from a generally elongated head bar, said window blind comprising:

at least two generally elongated and horizontal first slats, said first slats being in a superposed relationship relative to each other, each of said first slats having a first slat aperture extending therethrough, the first slat apertures of superposed first slats being in a generally vertically aligned relationship relative to each other;

a first tilt string defining a pair of first tilt string segments suspended from said head bar, said first tilt sting segments being in a generally parallel and spaced relationship relative to one another;

a set of first supporting strings extending between said first tilt string segments, each of said first supporting strings supporting a corresponding first slat;

a first tilt mechanism attached to said head bar and mechanically coupled to said first tilt string segments for selectively allowing relative vertical movement of said first tilt string segments in opposite direction relative to each other so as to pivot said first slats between open and closed configurations;

at least two generally elongated and horizontal second slats, said second slats being positioned in an underlying relationship relative to said first slats and in a superposed relationship with each other;

a second tilt string defining a pair of second tilt string segments suspended from said head bar, said second tilt string segments being in a generally parallel and spaced relationship relative to one another, said second tilt string segments extending vertically from said head bar through said vertically aligned first slat apertures;

a set of second supporting strings extending between said second tilt string segments, each of said second supporting string supporting a corresponding second slat;

a second tilt mechanism attached to said head bar and mechanically coupled to said second tilt string segments for selectively allowing relative vertical movement of said second tilt string segments in opposite direction relative to each other so as to pivot said second slats between open and closed configurations;

a biasing means for biasing said second tilt string segments towards a predetermined second segment spaced relationship relative to each other in a biasing region located between a lowermost first slat and an uppermost second slat, said biasing means ensuring that said second tilt string segments slide freely within said vertically aligned first slat apertures; each of said first slat apertures defining a corresponding first aperture peripheral edge; said biasing means ensuring that said second tilt string segments slide freely within said vertically aligned first slat apertures without contacting said first aperture peripheral edges.

2. A window blind as recited in claim 1 wherein said biasing means includes a retaining clip, said retaining clip defining an inner guiding surface, one of said second tilt string segments being attached to said retaining clip so as to move vertically solidarly therewith while the other second tilt string segments slides freely against said inner guiding surface.

3. A window blind as recited in claim 2 wherein said retaining clip has the general configuration of a loop, one of said second tilt string segments being attached to said loop while the other second tilt string segments slides freely against said inner guiding surface defined by said loop.

4. A window blind as recited in claim 2 wherein said loop has a generally oval configuration.

5. A window blind as recited in claim 2 wherein one of said second tilt string segments is attached to said loop by having an attachment segment of said loop extend therethrough.

6. A window blind as recited in claim 4 wherein one of said second tilt string segments is attached to said loop by having an attachment segment of said loop extend therethrough, said attachment segment of said loop being positioned adjacent a first longitudinal end of said loop; the other second tilt string segments sliding freely against said inner guiding surface defined by a guiding segment of said loop positioned adjacent a second longitudinal end of said loop, said second longitudinal end of said loop being positioned longitudinally opposite said first longitudinal end of said loop.

7. A window blind as recited in claim 3 further comprising a base bar attached to said shade underneath the lowermost second slat;

a drawstring defining at least one drawstring segment, said at least one drawstring segment extending from said head bar and being attached to said base bar, said at least one drawstring segment extending through said first slat apertures and through said loops formed by said clips;

a drawstring pulling means for allowing the pulling of said drawstring so as to allow the base bar and the first and second slats to be lifted towards said head bar in a shade retracted configuration.

8. A window blind as recited in claim 7 wherein said retaining clip is configured, sized and positioned so that when said shade is in said shade retracted configuration, the section of said second tilt string segment extending through said first slat apertures is folded between said first slats without protruding from a peripheral edge of said first slats.

9. In a window blind including a shade suspended from a generally elongated head bar, said shade including a first shade section, said first shade section including at least two generally elongated and horizontal first slats, said first slats being in a superposed relationship relative to each other, each of said first slats having a first slat aperture extending therethrough, the first slat apertures of superposed first slats being in a generally vertically aligned relationship relative to each other;

a first tilt string defining a pair of first tilt string segments suspended from said head bar, said first tilt sting segments being in a generally parallel and spaced relationship relative to one another;

a set of first supporting strings extending between said first tilt string segments, each of said first supporting strings supporting a corresponding first slat;

a first tilt mechanism attached to said head bar and mechanically coupled to said first tilt string segments for selectively allowing relative vertical movement of said first tilt string segments in opposite direction relative to each other so as to pivot said first slats between open and closed configurations;

a second individually tiltable shade section comprising:

at least two generally elongated and horizontal second slats, said second slats being positioned in an underlying relationship relative to said first slats and in a superposed relationship with each other;

a second tilt string defining a pair of second tilt string segments suspended from said head bar, said second tilt string segments being in a generally parallel and spaced relationship relative to one another, said second tilt string segments extending vertically from said head bar through said vertically aligned first slat apertures;

a set of second supporting strings extending between said second tilt string segments, each of said second supporting string supporting a corresponding second slat;

a second tilt mechanism attached to said head bar and mechanically coupled to said second tilt string segments for selectively allowing relative vertical movement of said second tilt string segments in opposite direction relative to each other so as to pivot said second slats between open and closed configurations;

a biasing means for biasing said second tilt string segments towards a predetermined second segment spaced relationship relative to each other in a biasing region located between a lowermost first slat and an uppermost second slat, said biasing means ensuring that said second tilt string segments slide freely within said vertically aligned first slat apertures; each of said first slat apertures defining a corresponding first aperture peripheral edge; said biasing means ensuring that said second tilt string segments slide freely within said vertically aligned first slat apertures without contacting said first aperture peripheral edges.

10. A window blind as recited in claim 9 wherein said biasing means includes a retaining clip, said retaining clip defining an inner guiding surface, one of said second tilt string segments being attached to said retaining clip so as to move vertically solidarly therewith while the other second tilt string segments slides freely against said inner guiding surface.

11. A window blind as recited in claim 10 wherein said retaining clip has the general configuration of a loop, one of said second tilt string segments being attached to said loop while the other second tilt string segments slides freely against said inner guiding surface defined by said loop.

12. A window blind as recited in claim 10 wherein said loop has a generally oval configuration.

13. A window blind as recited in claim 10 wherein one of said second tilt string segments is attached to said loop by having an attachment segment of said loop extend therethrough.

14. A window blind as recited in claim 13 wherein one of said second tilt string segments is attached to said loop by having an attachment segment of said loop extend therethrough, said attachment segment of said loop being positioned adjacent a first longitudinal end of said loop; the other second tilt string segments sliding freely against said inner guiding surface defined by a guiding segment of said loop positioned adjacent a second longitudinal end of said loop, said second longitudinal end of said loop being positioned longitudinally opposite said first longitudinal end of said loop.

15. A window blind as recited in claim 11 further comprising a base bar attached to said shade underneath the lowermost second slat;

a drawstring defining at least one drawstring segment, said at least one drawstring segment extending from said head bar and being attached to said base bar, said at least one drawstring segment extending through said first slat apertures and through said loops formed by said clips;

a drawstring pulling means for allowing the pulling of said drawstring so as to allow the base bar and the first and second slats to be lifted towards said head bar in a shade retracted configuration.

16. A window blind as recited in claim 15 wherein said retaining clip is configured, sized and positioned so that when said shade is in said shade retracted configuration, the section of said second tilt string segment extending through said first slat apertures is folded between said first slats without protruding from a peripheral edge of said first slats.

* * * * *